US009352608B2

(12) United States Patent
Hsu

(10) Patent No.: US 9,352,608 B2
(45) Date of Patent: May 31, 2016

(54) ELECTRIC PENCIL SHARPENER WITH AUTO-STOP FEATURE

(76) Inventor: Chia-Wen Hsu, Taichung (TW)

( * ) Notice: Subject to any disclaimer, the term of this patent is extended or adjusted under 35 U.S.C. 154(b) by 966 days.

(21) Appl. No.: 13/570,465

(22) Filed: Aug. 9, 2012

(65) Prior Publication Data

US 2013/0263971 A1 Oct. 10, 2013

(30) Foreign Application Priority Data

Apr. 6, 2012 (TW) ..... 101206292 U

(51) Int. Cl.
*B43L 23/00* (2006.01)
*B43L 23/02* (2006.01)

(52) U.S. Cl.
CPC ..... *B43L 23/008* (2013.01); *B43L 23/00* (2013.01); *B43L 23/004* (2013.01); *B43L 23/02* (2013.01)

(58) Field of Classification Search
CPC ..... B43L 23/00; B43L 23/008; B43L 23/004; B43L 23/08; B43L 23/06; B43L 23/085; B43L 23/04; B43L 23/02
See application file for complete search history.

(56) References Cited

U.S. PATENT DOCUMENTS 5,077,903 A * 1/1992 Kreim ..... B43L 23/02 144/28.1
7,455,087 B2 11/2008 Mak et al.
7,913,731 B2 3/2011 Sued et al.
2010/0326569 A1 12/2010 Dunlap et al.

* cited by examiner

*Primary Examiner* — Matthew G Katcoff
(74) *Attorney, Agent, or Firm* — Steptoe & Johnson LLP

(57) ABSTRACT

An electric pencil sharpener includes a cutter carrier, and first and second cutter members mounted on the cutter carrier and having long and short blade portions. The rear end of the short blade portion is disposed forwardly of the rear end of the long blade portion. A shaving space includes a rear region disposed between the rear ends of the long and short blade portions. The rear region allows extension of a tip portion of a pencil thereinto for pushing a switch actuation unit so as to deactivate a motor when the tip portion of the pencil has been sharpened to extend a predetermined length into the rear region.

10 Claims, 8 Drawing Sheets

ELECTRIC PENCIL SHARPENER WITH AUTO-STOP FEATURE

CROSS-REFERENCE TO RELATED APPLICATION

This application claims priority of Taiwanese Application No. 101206292, filed on Apr. 6, 2012.

BACKGROUND OF THE INVENTION

1. Field of the Invention

The invention relates to an electric pencil sharpener, more particularly to an electric pencil sharpener with an automatic stop feature.

2. Description of the Related Art

One type of conventional electric pencil sharpeners, such as those disclosed in US 2010/032658A1 and U.S. Pat. No. 7,455,087B2, is configured to automatically stop a pencil sharpening operation when a predetermined length of the tip portion of an inserted pencil has been sharpened. This type of electric pencil sharpener is typically provided with a single helical cutter or a single flat blade so as to provide a space for installing an auto-stop mechanism. However, this type of electric pencil sharpener typically suffers from balancing problems during the pencil sharpening operation, resulting in an unstable shaving quality.

Another type of conventional electric pencil sharpeners, such as those disclosed in U.S. Pat. No. 7,913,731B2 and US 2010/0326569A1, is provided with two helical cutters which are substantially equal in length to provide better balance. However, with the provision of the additional cutter, the electric pencil sharpener no longer has space for accommodating an auto-stop mechanism.

SUMMARY OF THE INVENTION

Therefore, the object of the present invention is to provide an electric pencil sharpener with dual cutters and an automatic stop feature.

Accordingly, an electric pencil sharpener of the present invention includes a drive unit, a cutter assembly, and a switch unit. The drive unit includes a motor. The cutter assembly includes a cutter carrier operatively connected to the motor, and first and second cutter members mounted on the cutter carrier. The cutter carrier has an open front end portion adapted to permit insertion of a pencil, and a rear end portion. The first cutter member has a long blade portion with a first rear end. The second cutter member has a short blade portion with a second rear end. The short blade portion has a length shorter than that of the long blade portion. The second rear end of the short blade portion is disposed forwardly of the first rear end of the long blade portion. A shaving space is formed between the first and second cutter members and extends rearwardly from the open front end portion of the cutter carrier for receiving the pencil. The shaving space includes a front region disposed forwardly of the second rear end of the short blade portion, and a rear region disposed between said second rear end of the short blade portion and the first rear end of the long blade portion. The rear region allows extension of a tip portion of the pencil thereinto during sharpening of the tip portion of the pencil. The switch assembly includes a shutoff switch operatively connected to the motor for deactivating the motor, and a switch actuation unit disposed movably in the rear end portion of the cutter carrier and extendible into the rear region. The switch actuation unit is movable between an actuation position in which the shutoff switch is actuated by the switch actuation unit to deactivate the motor, and a non-actuation position in which the shutoff switch is not actuated. The switch actuation unit is movable by the tip portion of the pencil to the actuation position when the tip portion of the pencil has been sharpened to extend a predetermined length into the rear region.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
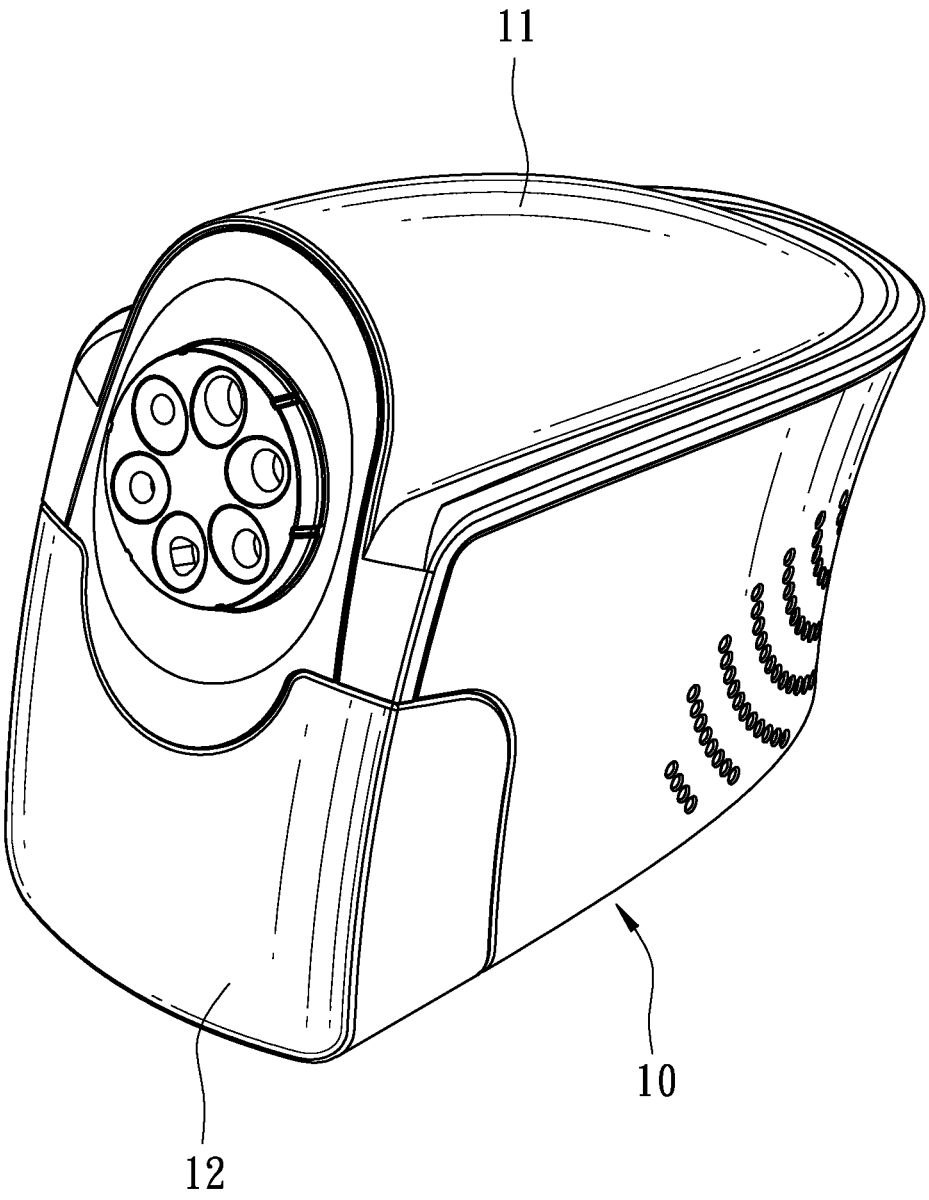
FIG. 1 is a perspective view showing the outer appearance of a preferred embodiment of the electric pencil sharpener of the present invention.
Figure 2:
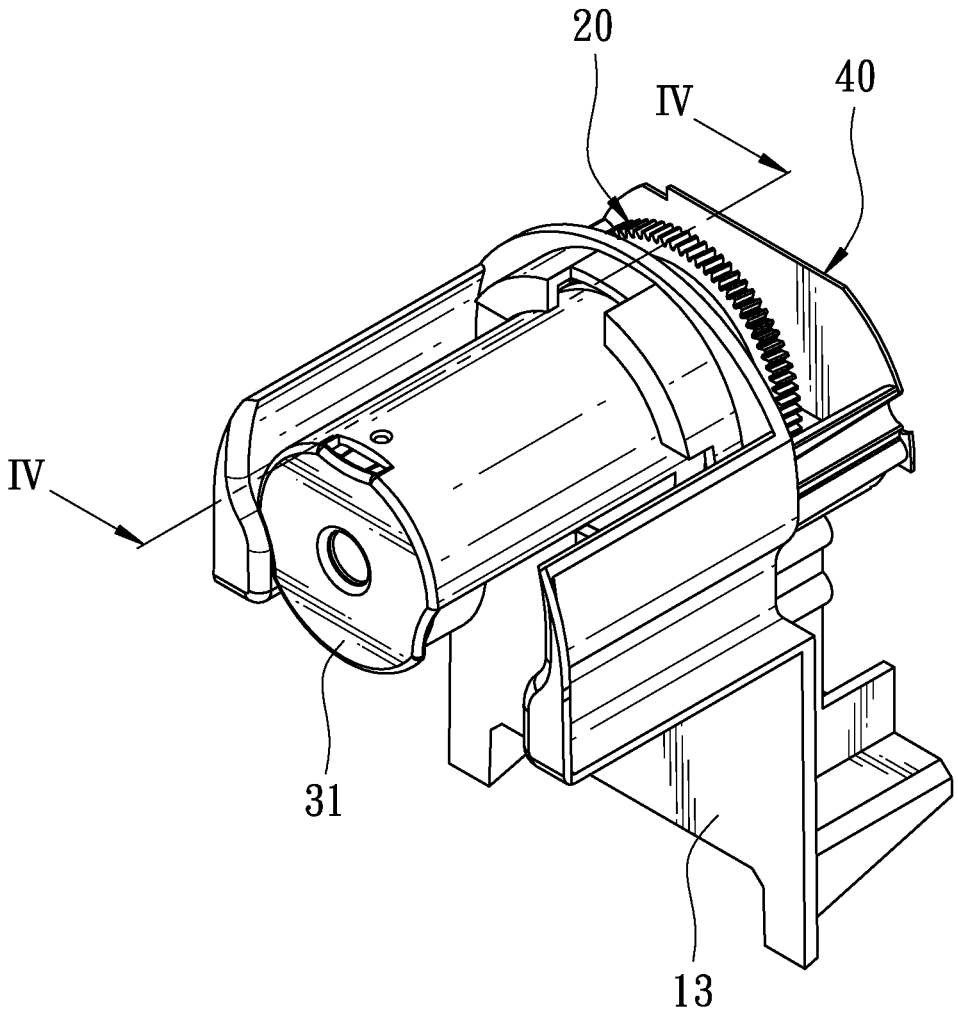
FIG. 2 is a fragmentary assembled perspective view of the preferred embodiment of the electric pencil sharpener of the present invention.
Figure 3:
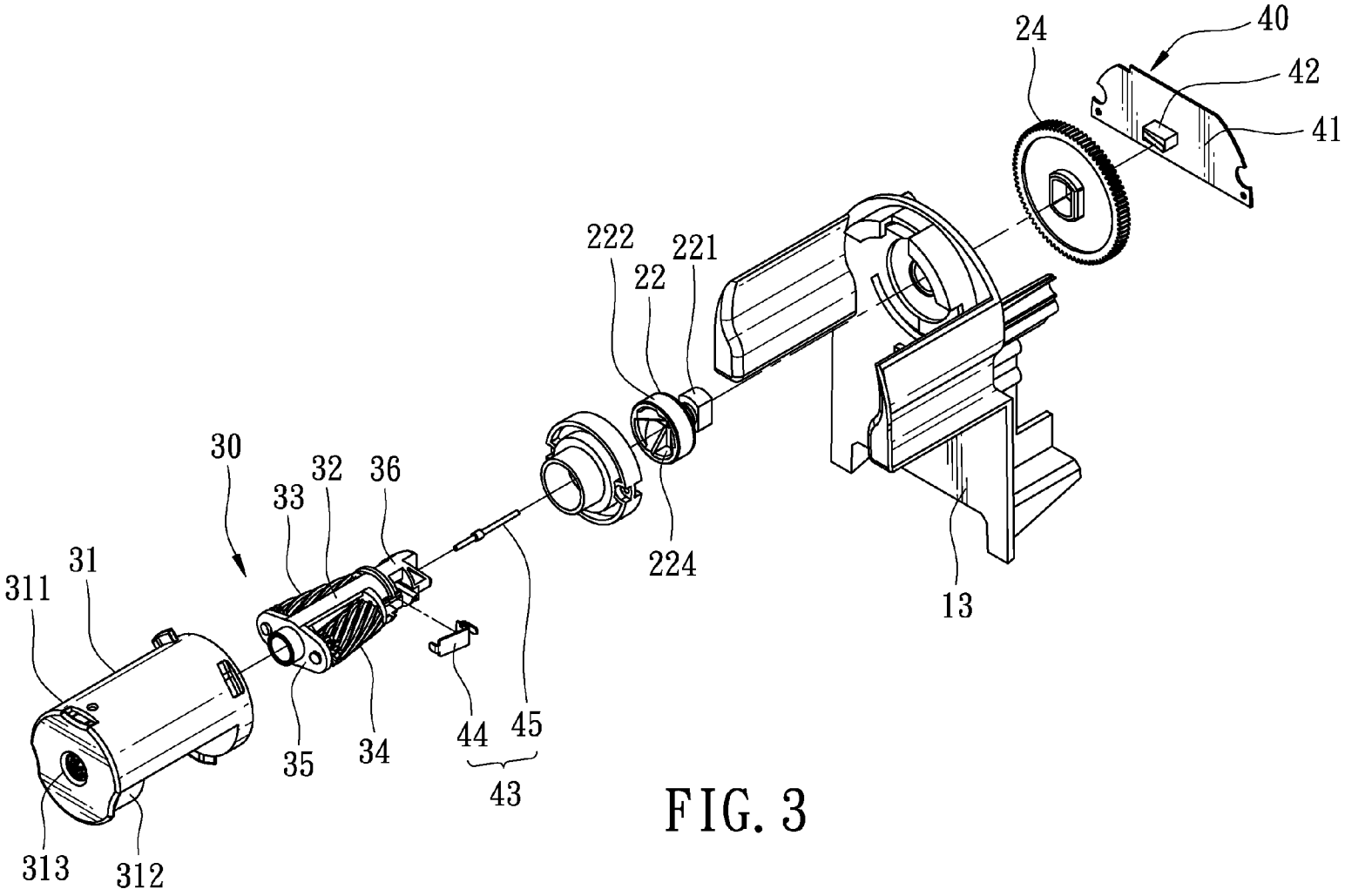
FIG. 3 is an exploded perspective view of FIG. 2.

As shown in FIGS. 1, 2 and 3, the preferred embodiment of an electric pencil sharpener according to the present invention includes a housing 10, a drive unit 20, a cutter assembly 30, and a switch assembly 40.

The housing 10 includes an outer wall 11, a shaving collector 12 mounted removably on the outer wall 11, a partition wall 13 mounted within the outer wall 11, and a cutter shell 31 disposed in front of the partition wall 13 and mounted on the partition wall 13.

Figure 4:
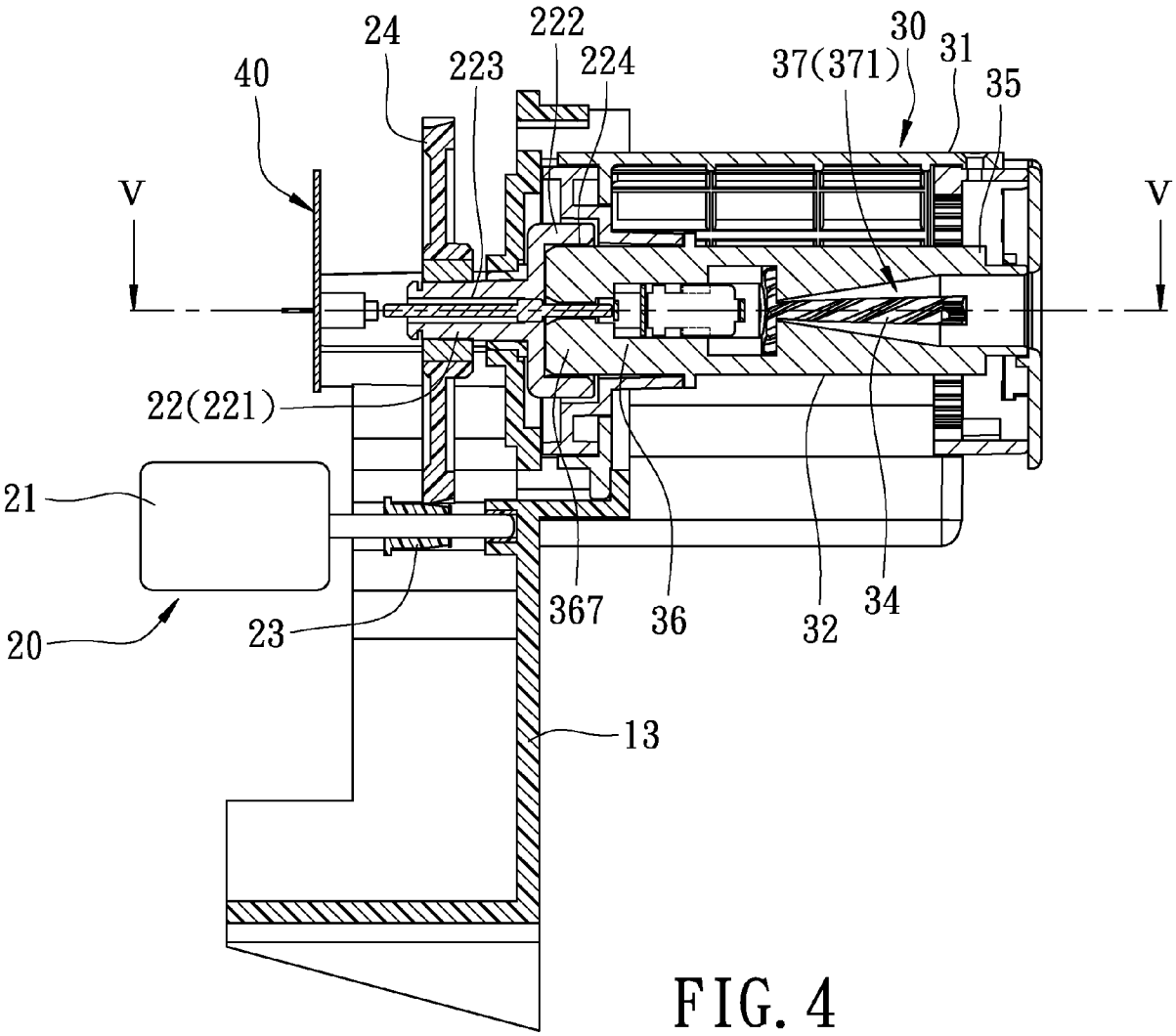
FIG. 4 is a cross-sectional view of the preferred embodiment, taken along line IV-IV in FIG. 2 and showing an actuation switch unit at a non-actuation position.

Referring to FIGS. 3 and 4, the drive unit 20 includes a motor 21 mounted within the housing 10, a coupling member 22 mounted between the cutter assembly 30 and the motor 21, and first and second gears 23, 24.

The first gear 23 is coupled co-rotatably to a rotary shaft of the motor 21. The second gear 24 engages the first gear 23. The coupling member 22 has a first end 221 coupled co-rotatably to the second gear 24, a second end 222 opposite to the first end 221, a first pin hole 223 formed through the first and second ends 221, 222, and an engaging groove 224 formed in the second end 222.

Figure 5:
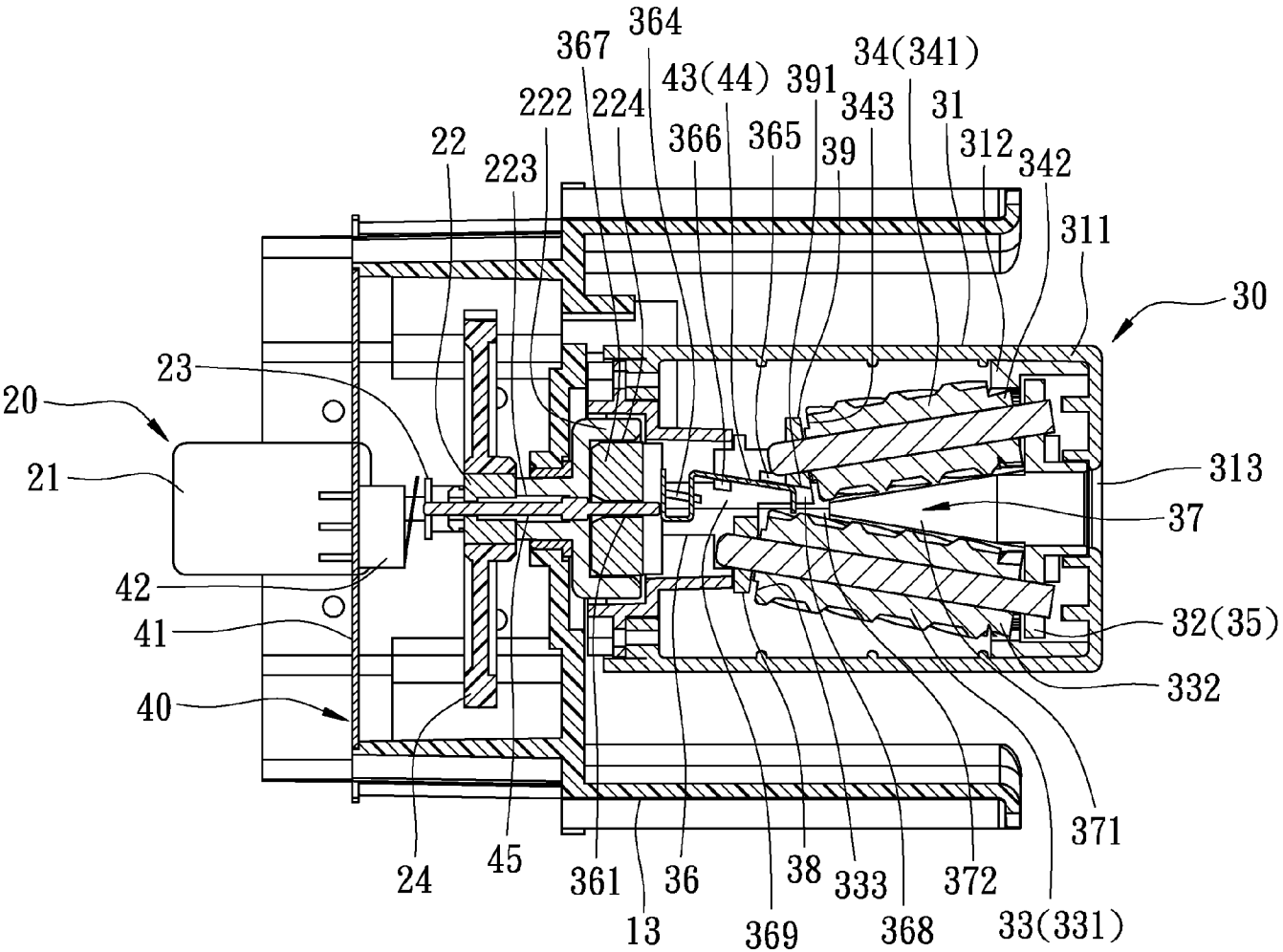
FIG. 5 is cross-sectional view of the preferred embodiment, taken along line V-V in FIG. 4.
Figure 6:
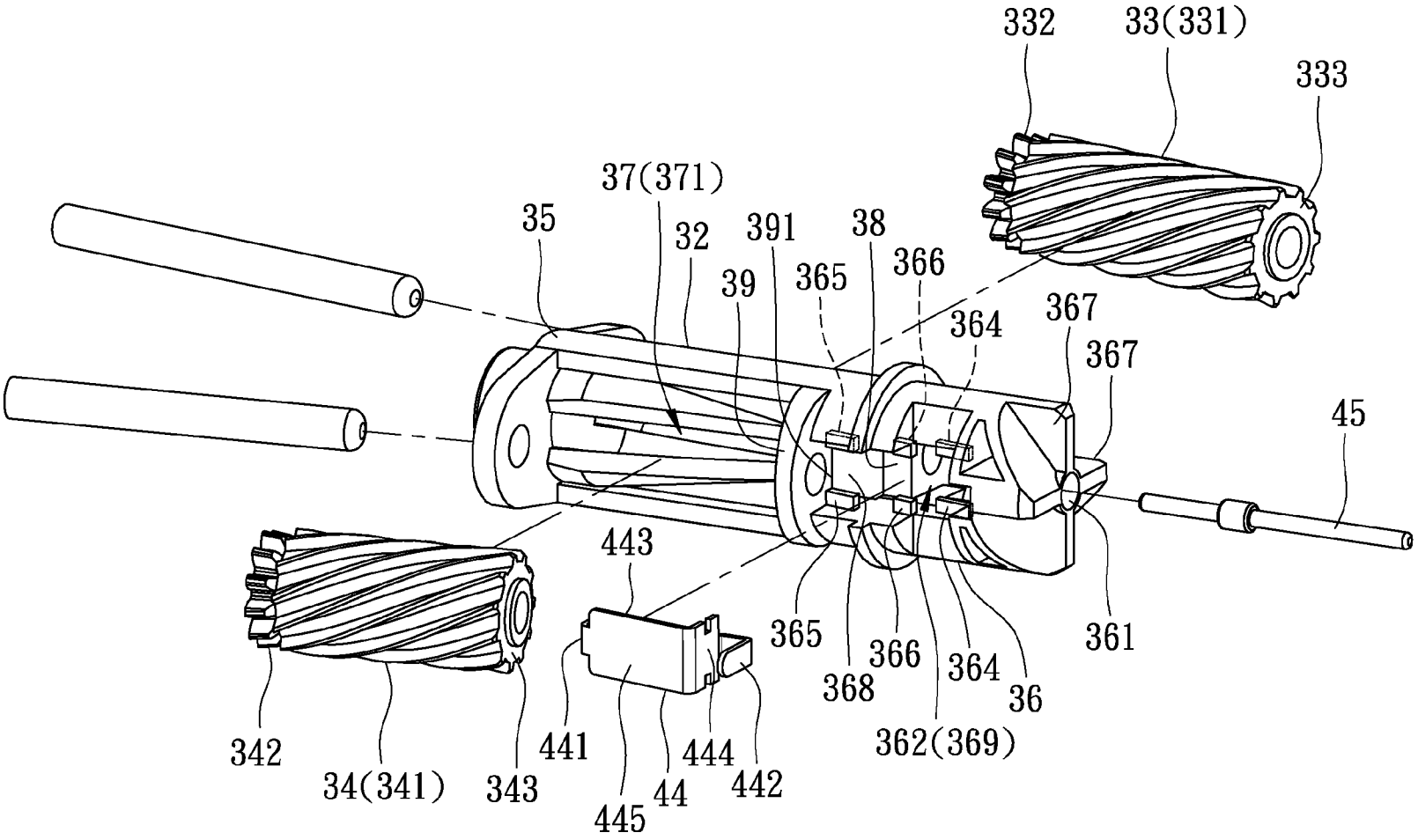
FIG. 6 is a fragmentary exploded perspective view of the preferred embodiment, showing a cutter assembly and a switch actuation unit.

Referring to FIGS. 3, 5 and 6, the cutter assembly 30 includes a cutter carrier 32 received in the cutter shell 31, and first and second cutter members 33, 34 mounted rotatably on the cutter carrier 32. In the present embodiment, each of the first and second cutter members 33, 34 is in the form of a helical cutter. The first cutter member 33 has a long blade portion 331 with a first rear end 333 and a front end formed with a series of circumferential first engaging teeth 332 which are arranged annularly. The second cutter member 34 has a short blade portion 341 which has a length shorter than that of the long blade portion 331, a second rear end 343 disposed forwardly of the first rear end 333, and a front end formed with a series of circumferential second engaging teeth 342 which are arranged annularly. The cutter shell 31 has a front end 311 formed with a pencil bore 313 and a series of third engaging teeth 312 which are arranged annularly for engaging the first and second engaging teeth 332, 342.

The cutter carrier 32 has an open front end portion 35 adapted to permit insertion of a pencil via the pencil bore 313, and a rear end portion 36 formed with a first pivot lobe 38 and a second pivot lobe 39 disposed forwardly of the first pivot lobe 38. A conical shaving space 37 is formed in the cutter carrier 32 between the first and second cutter members 33, 34 and extends from the open front end portion 35 toward the rear end portion 36 of the cutter carrier 32. The shaving space 37 includes a front region 371 disposed forwardly of the second rear end 343 of the short blade portion 341, and a rear region 372 disposed between the second rear end 343 of the short blade portion 341 and the first rear end 333 of the long blade portion 331.

The first cutter member 33 is disposed between and mounted rotatably on the front end portion 35 and the first pivot lobe 38 of the cutter carrier 32. The second cutter member 34 is disposed between and mounted rotatably on the front end portion 35 and the second pivot lobe 39 of the cutter carrier 32. The second pivot lobe 39 has an inner wall surface 391 facing the rear region 372.

The rear end portion 36 of the cutter carrier 32 is formed with a second pin hole 361 aligned with the first pin hole 223 in the coupling member 22, and a slide groove 362 disposed forwardly of the second pin hole 361. The slide groove 362 includes a front groove part 368 disposed between the inner wall surface 391 of the second pivot lobe 39 and the rear region 372 of the shaving space 37 and in spatial communication with the rear region 372, and a rear groove part 369 disposed adjacent to and in spatial communication with the second pin hole 361. The rear end portion 36 of the cutter carrier 32 is further formed with a pair of spaced-apart first guiding blocks 365, a pair of spaced-apart second guiding blocks 366, and a pair of spaced-apart guiding rails 364 which are all disposed in the slide groove 362. The pair of first guiding blocks 365 are offset from the pair of second guiding blocks 366. Several engaging keys 367 are formed at a distal end of the second end portion 36 of the cutter carrier 32 for engaging the engaging groove 224 in the coupling member 22 such that the cutter carrier 32 is coupled co-rotatably with the coupling member 22.

The switch assembly 40 includes a circuit board 41 disposed posteriorly of the partition wall 13 and mounted to the partition wall 13, a shutoff switch 42 provided on the circuit board 41 and operatively connected to the motor 21 for deactivating the motor 21, and a switch actuation unit 43 disposed slidably in the rear end portion 36 of the cutter carrier 32.

The switch actuation unit 43 includes a slide piece 44 received slidably in the slide groove 362 and extendable into the rear region 372 of the shaving space 37, and an actuation pin 45 extending slidably through the first pin hole 223 in the coupling member 22 and the second pin hole 361 in the rear end portion 36 of the cutter carrier 32. The actuation pin 45 has a front end disposed in the rear groove part 369 of the slide groove 362, and a rear end projecting rearwardly from the first pin hole 223 and disposed proximate to the shutoff switch 42. The slide piece 44 has a front end wall 441 disposed in the front groove part 368 and extendible into the rear region 372 of the shaving space 37, a rear end wall 442 abutting against the front end of the actuation pin 45, and an L-shaped connecting wall 443 interconnecting the front and rear end walls 441, 442. The connecting wall 443 has a first wall part 445 extending rearwardly from the front end wall 441, and a second wall part 444 connected transversely to the first wall part 445. The first wall part 445 is disposed slidably between the pair of first guiding blocks 365 and the pair of second guiding blocks 366. The second wall part 444 is disposed between the guiding rails 364, and has upper and lower edges formed with notches which engage slidably the pair of guiding rails 364. The switch actuation unit 43 is movable between a non-actuation position (see FIGS. 5 and 7) in which the shutoff switch 42 is not actuated by the actuation pin 45, and an actuation position (see FIG. 8) in which the shutoff switch 42 is actuated by the actuation pin 45 to deactivate the motor 21. The slide piece 44 is slidable along the guiding rails 364 when the switch actuation unit 43 is moved between the actuation position and the non-actuation position.

Figure 7:
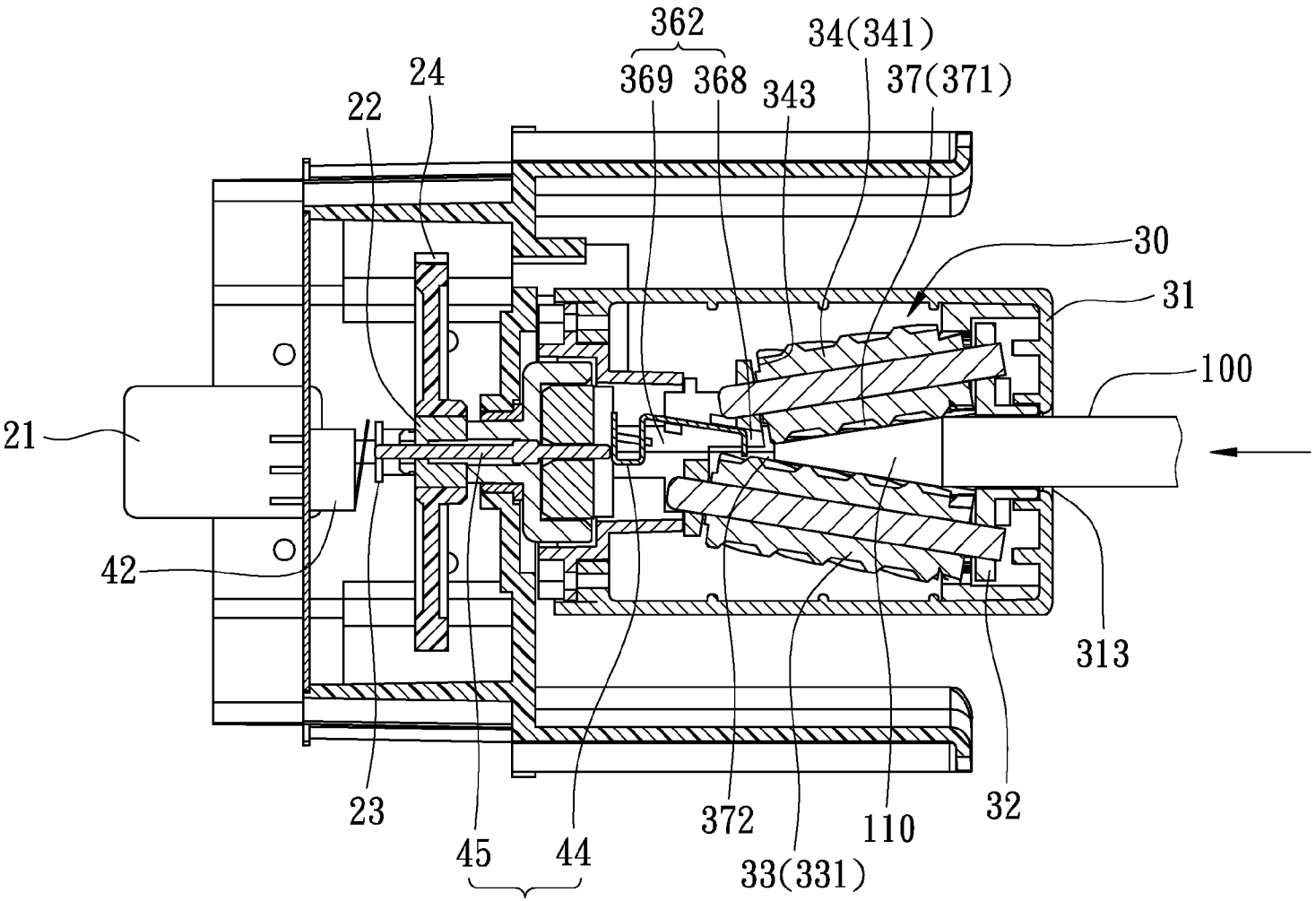
FIG. 7 is another cross-sectional view of the preferred embodiment showing a pencil being sharpened.
Figure 8:
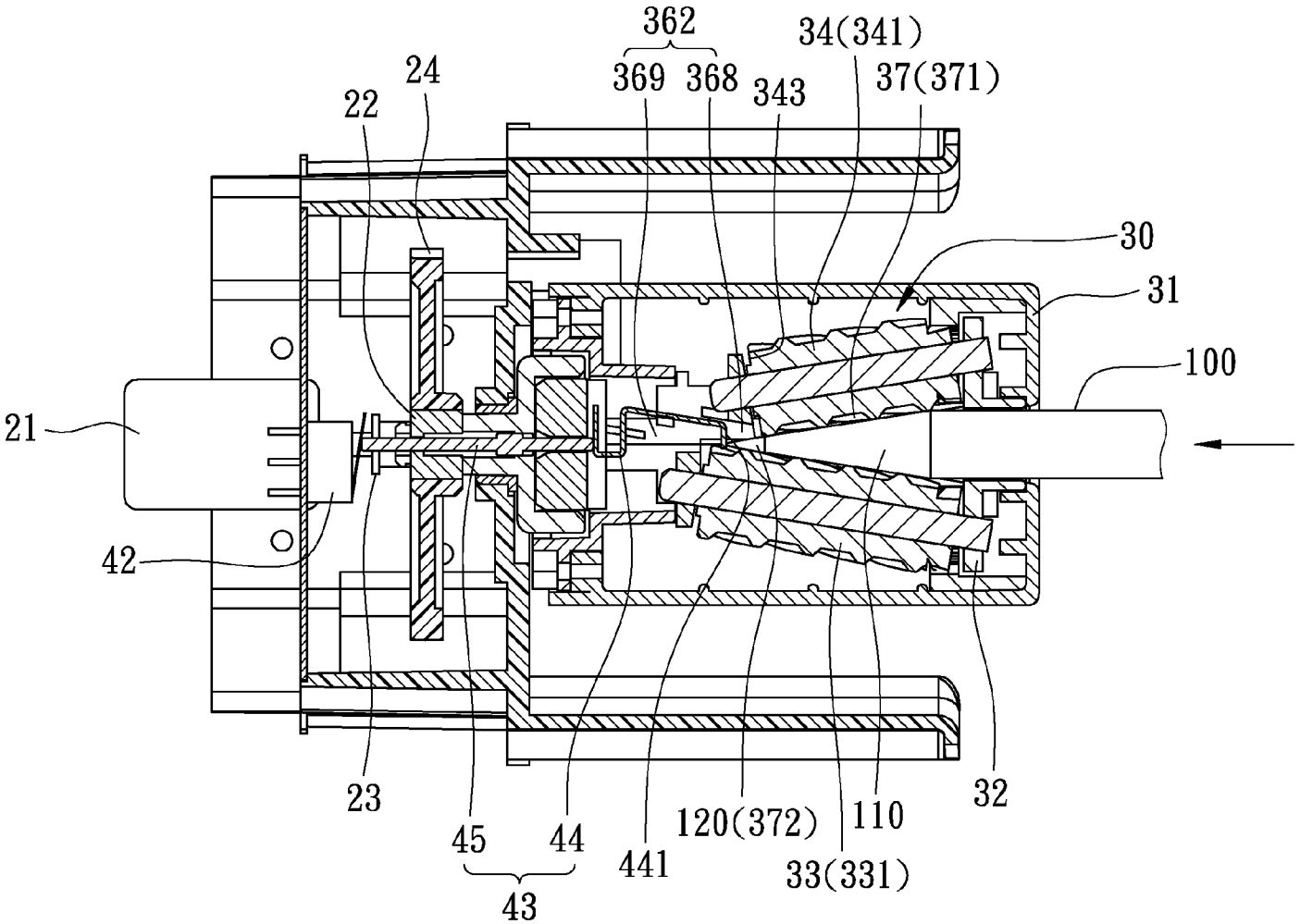
FIG. 8 is yet another cross-sectional view of the preferred embodiment similar to FIG. 7, showing the switch actuation unit being moved by a sharpened tip portion of the pencil.

Referring to FIGS. 7 and 8, in use, when a pencil 100 is inserted into the shaving space 37 via the pencil bore 313 in the cutter shell 31, the motor 21 is activated and a rotary driving force is transmitted to the cutter carrier 32 via the first and second gears 23, 24 and the coupling member 22 such that the cutter carrier 32 is rotated relative to the cutter shell 31, resulting in corresponding revolution and rotation of the first and second cutter members 33, 34 so as to perform a sharpening operation upon the pencil 100. During the sharpening operation, an inserted end portion 110 of the pencil 100 is shaved by the long and short blade portions 331, 341 simultaneously in the front region 371 of the shaving space 37. As the sharpening operation continues, a distal tip portion 120 of the pencil 100 enters the rear region 372 of the shaving space 37 and is shaved by the long blade portion 331 of the first cutter member 33 only. When the tip portion 120 of the pencil 100 has been sharpened to extend a predetermined length into the rear region 372, the front end wall 441 of the slide piece 44 is pushed by the tip portion 120 of the pencil 100 and is moved rearwardly, thereby pushing the actuation pin 45 rearward such that the rear end of the actuation pin 45 contacts the shutoff switch 42 and actuates the shutoff switch 42, thus deactivating the motor 21 to cease the sharpening operation.

In view of the foregoing, the electric pencil sharpener of the present invention provides the following advantages:

1. Since two cutter members 33, 34 are provided, the electric pencil sharpener of the present invention has better balancing properties, leading to an enhanced shaving quality.
2. With the provision of the long and short blade portions 331, 341, a slide groove 362 with a front groove portion 368 in spatial communication with the rear region 372 is provided to permit installation and sliding movement of a switch actuation unit 43, thus providing an automatic stop feature.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. An electric pencil sharpener, comprising:

a drive unit including a motor;

a cutter assembly which includes:

a cutter carrier operatively connected to said motor, said cutter carrier having an open front end portion adapted to permit insertion of a pencil, and a rear end portion;

a first cutter member mounted on said cutter carrier and having a long blade portion with a first rear end;

a second cutter member mounted on said cutter carrier and having a short blade portion with a second rear end, said short blade portion having a length shorter than that of said long blade portion, said second rear end being disposed forwardly of said first rear end of said long blade portion; and a shaving space formed between said first and second cutter members and extending rearwardly from said open front end portion of said cutter carrier for receiving the pencil, said shaving space including a front region disposed forwardly of said second rear end of said short blade portion, and a rear region disposed between said second rear end of said short blade portion and said first rear end of said long blade portion, said rear region allowing extension of a tip portion of the pencil thereinto during sharpening of the tip portion of the pencil; and a switch assembly including a shutoff switch operatively connected to said motor for deactivating said motor, and a switch actuation unit disposed movably in said rear end portion of said cutter carrier and extendible into said rear region, said switch actuation unit being movable between an actuation position in which said shutoff switch is actuated by said switch actuation unit to deactivate said motor, and a non-actuation position in which said shutoff switch is not actuated, said switch actuation unit being movable by the tip portion of the pencil to said actuation position when the tip portion of the pencil has been sharpened to extend a predetermined length into said rear region.

2. The electric pencil sharpener as claimed in claim 1, wherein each of said first and second cutter members is in the form of a helical cutter and is mounted rotatably on said cutter carrier.

3. The electric pencil sharpener as claimed in claim 2, wherein said cutter carrier is formed with a first pivot lobe and a second pivot lobe disposed forwardly of said first pivot lobe, said first cutter member being mounted on said front end portion of said cutter carrier and said first pivot lobe, said second cutter member being mounted on said front end portion of said cutter carrier and said second pivot lobe, said rear end portion of said cutter carrier being formed with a slide groove in spatial communication with said shaving space for receiving said switch actuation unit.

4. The electric pencil sharpener as claimed in claim 3, wherein said second pivot lobe has an inner wall surface facing said rear region, said slide groove including a front groove part disposed between said inner wall surface and said rear region, and a rear groove part connected to said front groove part.

5. The electric pencil sharpener as claimed in claim 2, further comprising a cutter shell for receiving said cutter carrier, said cutter shell having a front end formed with a pencil bore in spatial communication and aligned with said open front end portion of said cutter carrier and a rear end opposite to said front end of said cutter shell, said first cutter member having a front end formed with a series of first teeth which are disposed forwardly of said long blade portion, said second cutter member having a front end formed with a series of second teeth which are disposed forwardly of said short blade portion, said cutter shell having a front end formed with a series of third teeth which are arranged annularly for engaging said first and second teeth.

6. The electric pencil sharpener as claimed in claim 5, wherein said drive unit includes a coupling member with a first end coupled to said motor and a second end opposite to said first end and coupled to said cutter carrier for transmitting rotary drive force from said motor to said cutter carrier, said coupling member being formed with a first pin hole extending through said first and second ends, said rear end portion of said cutter carrier being formed with a second pin hole aligned with said first pin hole and in spatial communication with said slide groove, said switch actuation unit including a slide piece received slidably in said slide groove and an actuation pin extending through said first and second pin holes, said actuation pin having a front end abutting against said slide piece and a rear end disposed proximate to said shutoff switch, said rear end of said actuation pin being moved toward said shutoff switch so as to be in contact with said shutoff switch when said switch actuation unit is moved to the actuation position.

7. The electric pencil sharpener as claimed in claim 6, wherein said slide piece has a front end wall extendible into said rear region for contact with the tip portion of the pencil, a second end wall opposite to said first end wall and abutting against said first end of said actuation pin, and a connecting wall interconnecting said first and second end walls, said rear end portion of said cutter carrier further having a guiding unit including a pair of first guiding blocks and a pair of second guiding blocks offset from said first guiding blocks, said connecting wall including a first wall part disposed slidably between said first guiding blocks and said second guiding blocks.

8. The electric pencil sharpener as claimed in claim 7, wherein said guiding unit further includes a pair of guiding rails, said connecting wall of said slide piece further including a second wall part connected transversely to said first wall part, said second wall part being disposed between said guiding rails and being slidable along said guiding rails when said switch actuation unit is moved between the actuation position and the non-actuation position.

9. The electric pencil sharpener as claimed in claim 6, wherein said motor has a rotary shaft, said drive unit further including a first gear coupled co-rotatably to said rotary shaft and a second gear engaging said first gear, said first end of said coupling member being coupled co-rotatably to said second gear.

10. The electric pencil sharpener as claimed in claim 5, further comprising a partition wall fixed to said rear end of said cutter shell, said switch assembly further including a circuit board mounted with said shutoff switch, said circuit board being disposed posteriorly of said partition wall and being mounted to said partition wall.

* * * * *